US009484690B2

(12) United States Patent
Chang et al.

(10) Patent No.: US 9,484,690 B2
(45) Date of Patent: Nov. 1, 2016

(54) MODULAR ELECTRICAL CONNECTOR

(71) Applicants: DONGGUAN JIAN GUAN PLASTIC ELECTRONIC CO., LTD., Dongguan/Guangdong (CN); U. D. ELECTRONIC CORP., Taoyuan (TW); U. D (ZHONG JIANG) ELECTRONIC CORP., Deyang/Sichuan (CN)

(72) Inventors: Chih-Kai Chang, Taoyuan (TW); Zhi-Quan Shang, Dongguan (CN)

(73) Assignees: DONGGUAN JIAN GUAN PLASTIC ELECTRONIC CO., LTD. (CN); U. D. ELECTRONICS CORP. (TW); U. D. (ZHONG JIANG) ELECTRONIC CORP. (CN)

( * ) Notice: Subject to any disclaimer, the term of this patent is extended or adjusted under 35 U.S.C. 154(b) by 0 days.

(21) Appl. No.: 14/870,206

(22) Filed: Sep. 30, 2015

(65) Prior Publication Data

US 2016/0240985 A1 Aug. 18, 2016

(30) Foreign Application Priority Data

Feb. 13, 2015 (CN) ..... 2015 2 0104824 U

(51) Int. Cl.
*H01R 24/64* (2011.01)
*H01R 25/00* (2006.01)

(52) U.S. Cl.
CPC ..... *H01R 24/64* (2013.01); *H01R 25/00* (2013.01)

(58) Field of Classification Search
CPC ..... H01R 13/6658; H01R 23/025; H01R 23/6873; H01R 13/65802
USPC ..... 439/76.1, 607.38, 607.26
See application file for complete search history.

(56) References Cited

U.S. PATENT DOCUMENTS

| | | | | |
|---|---|---|---|---|
| 6,872,094 | B1 * | 3/2005 | Murr | G02B 6/4201 439/607.2 |
| 7,597,562 | B2 * | 10/2009 | Genesius | H01R 13/514 439/372 |
| 7,896,659 | B1 * | 3/2011 | Westman | H01R 13/514 439/108 |
| 7,946,859 | B1 * | 5/2011 | Tseng | H05K 5/0026 439/676 |
| 8,157,583 | B1 * | 4/2012 | Wei | H01R 13/6594 439/540.1 |
| 8,403,701 | B2 * | 3/2013 | Han | H01R 13/6594 439/541.5 |
| 2003/0139072 | A1 * | 7/2003 | Na | H05K 1/147 439/76.1 |
| 2003/0186586 | A1 * | 10/2003 | Gutierrez | H01R 24/64 439/607.26 |
| 2005/0181643 | A1 * | 8/2005 | Brower | H04L 67/02 439/76.1 |
| 2014/0295704 | A1 * | 10/2014 | Curtis | H01R 13/65802 439/607.26 |

* cited by examiner

*Primary Examiner* — Gary Paumen

(57) ABSTRACT

The present invention relates to a modular electrical connector, and the modular electrical connector can be divided into three modules including: housing, connecting modules, and RJ45 receiving modules, wherein the housing is used for disposed on a circuit board of an external host case, and the connecting modules and the RJ45 receiving modules are assembled and disposed in the housing so as to electrically connected with the circuit board; according to the modular design of the present invention, the RJ45 receiving modules are able to be individually disassembled from the connecting modules and the connector, thus, user does not have to disassembles whole connector during the RJ45 connector's repairing or replacing process.

9 Claims, 7 Drawing Sheets

MODULAR ELECTRICAL CONNECTOR

BACKGROUND OF THE INVENTION

1. Field of the Invention

The present invention relates to technology filed of electrical connectors, and more particularly, to a modular electrical connector.

2. Description of the Prior Art

With the development and advancement of computer technology, laptop and desktop computers are widely used in human society, wherein the development and advancement are aimed chiefly at increasing the function and speed of the computer as well as reducing the size of the computer. By the interconnection of the computer and Internet technologies, people's living, learning, working and recreation are therefore led to an another new realm. Therefore, computer and Internet play indispensable roles in modern people's life.

Electrical connector is the bridge for linking computer and Internet. After carrying out the interconnection of at least one network transmission cable and the electrical connector of the computer, the computer is able to link with world wide web via Internet. Moreover, according to different internet requirements, multiple port connectors are developed for being applied in server computers; therefore, by facilitating different networks to connect with each other, the development of computer and internet technology are rapidly expanded.

Please refer to FIG. 1, there is shown a schematic assembly diagram that a conventional multiple port connector is embedded into a server. As shown in FIG. 1, the conventional multiple port connector 1', designed as an integrated structure, includes a plurality of RJ45 connectors 11' and a plurality of output terminals 12'. When embedded the conventional multiple port connector 1' into one electronic device such as a server, the whole multiple port connector 1' would be firmly installed on a printed circuit board (PCB) 2' by welding the output terminals 12' of the multiple port connector 1' onto the PCB 2'.

Moreover, after installing the multiple port connector 1' on the PCB 2', the PCB 2' would be disposed into a housing 3' of the electrical device; meanwhile, the RJ45 connectors 11' of the multiple port connector 1' would be exposed out of the housing 3' through the opening 31'. Therefore, user can directly plug the network transmission cable into the RJ45 connectors 11' form outside of the housing 3'.

The conventional multiple port connector 1' has advantages like easy to be installed on the PCB 2'; however, the conventional multiple port connector 1' still has following disadvantages:

1. Due to the integrated structure of the conventional multiple port connector, user must disassembles whole multiple port connector 1' form the PCB 2' when any one of the RJ45 connectors 11' need to be repaired or replaced.

2. Inheriting to above point 1, moreover, for the RJ45 connector 11' cannot be individually disassembled, it needs to replace the multiple port connector 1' with a new one for carrying out the repairing process when any one of the RJ45 connectors 11' is damaged or broken.

Accordingly, in view of the conventional multiple port connector still have some shortcomings and drawbacks, the inventor of the present application has made great efforts to make inventive research thereon and eventually provided an modular electrical connector.

SUMMARY OF THE INVENTION

The primary objective of the present invention is to provide a modular electrical connector, which includes housing, connecting modules, and RJ45 receiving modules, wherein the housing is used for disposed on a circuit board of an external host case, and the connecting modules and the RJ45 receiving modules are assembled and disposed in the housing so as to electrically connected with the circuit board; moreover, according to the modular design of the present invention, the RJ45 receiving modules are able to be individually disassembled from the connecting modules and the connector, thus, user does not have to disassembles whole connector during the RJ45 connector's repairing or replacing process.

Accordingly, to achieve the above objectives of the present invention, the inventor proposes a modular electrical connector, comprising:

- a housing, being used for disposed on a circuit board of an external host case, and having a receiving space;
- at least one connecting module, being disposed in the receiving space, and comprising:
  - a first insulating body; and
  - a plurality of connecting terminals, being electrically connected with the circuit board, wherein each of the connecting terminals have a contact portion; and
- at least one RJ45 receiving module, being disposed into the receiving space and opposite to the connecting module, wherein the RJ45 receiving module is used for receiving an external RJ45 plugs; moreover, the RJ45 receiving module comprising a printed circuit board (PCB) and a plurality of electrical terminals electrically connected to the PCB;
- wherein the PCB of the RJ45 receiving module is formed with an edge-board contact portion, and the edge-board contact portion would connect with the contact portions of the connecting terminals when the RJ45 receiving module is disposed in the receiving space, such that the electrical terminals are electrically connected with the connecting terminals.

BRIEF DESCRIPTION OF THE DRAWINGS

The invention as well as a preferred mode of use and advantages thereof will be best understood by referring to the following detailed description of an illustrative embodiment in conjunction with the accompanying drawings, wherein.

DETAILED DESCRIPTION OF THE PREFERRED EMBODIMENTS

To more clearly describe an modular electrical connector according to the present invention, embodiments of the present invention will be described in detail with reference to the attached drawings hereinafter.

Figure 1:
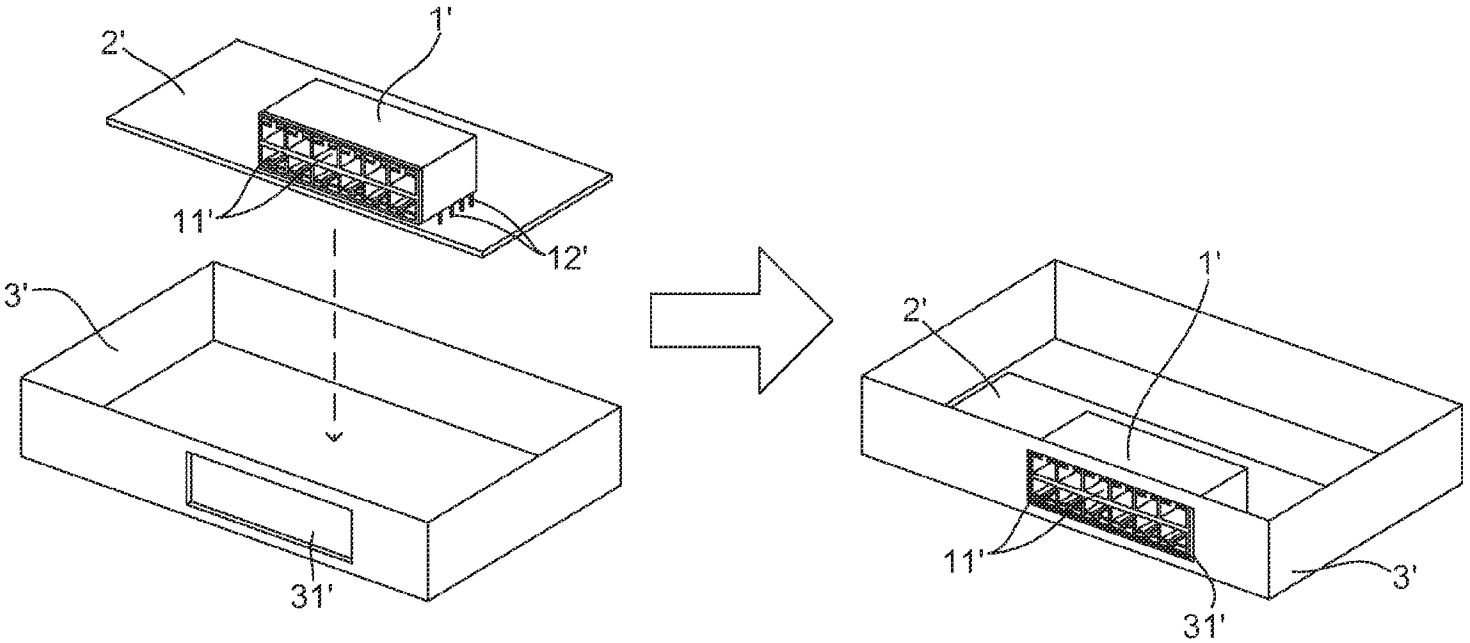
FIG. 1 (Prior Art)
FIG. 1 is a schematic assembly diagram that a conventional multiple port connector is embedded into a server.
Figure 2:
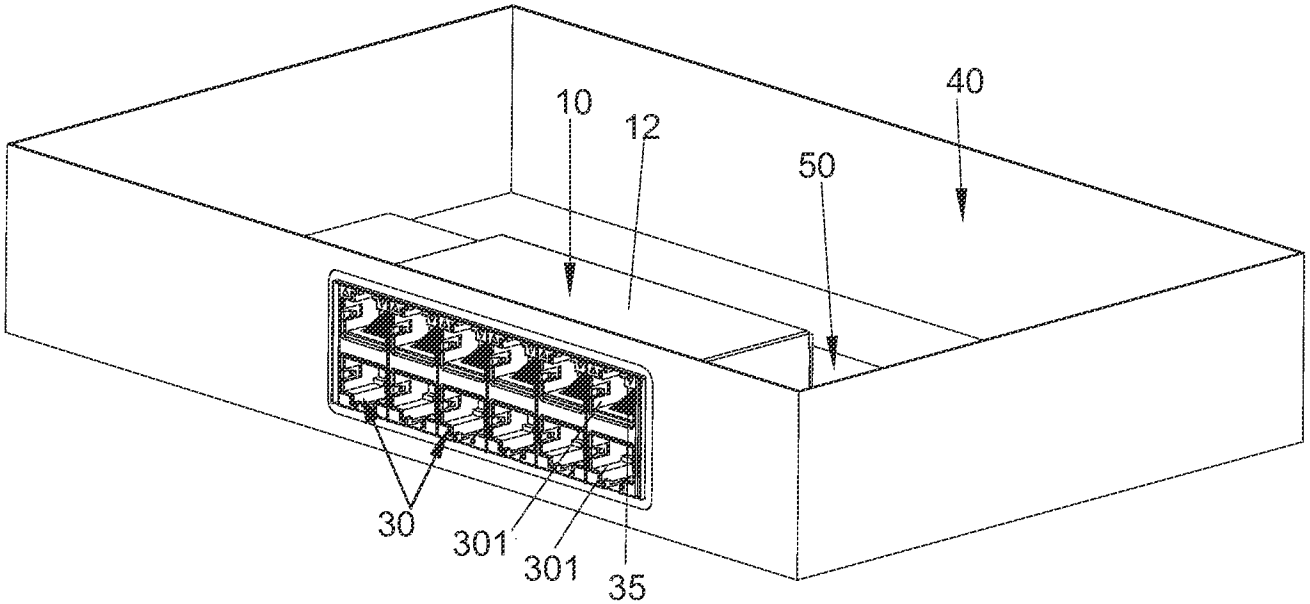
FIG. 2 is a stereo view of a modular electrical connector according to the present invention being deposed in an external device.
Figure 3:
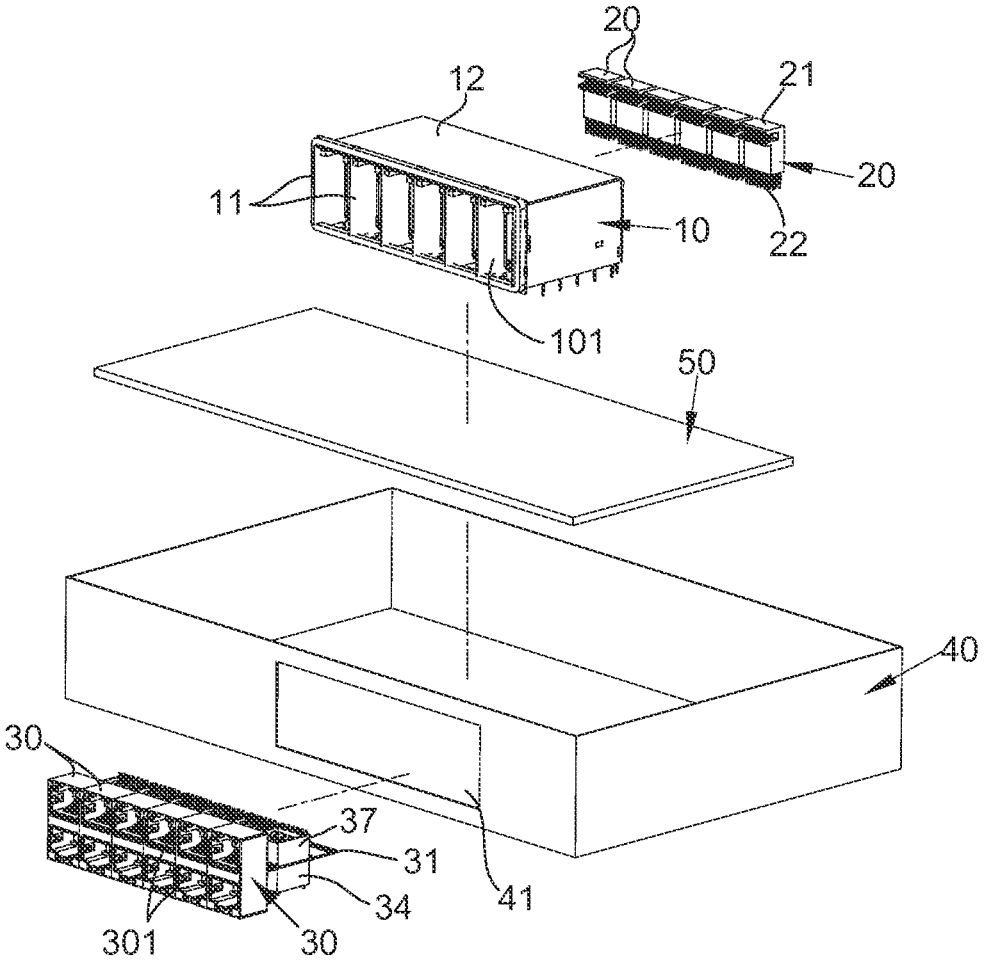
FIG. 3 is an exploded view of the FIG. 2.

With reference to FIG. 2, FIG. 3, FIG. 4, FIG. 5, FIG. 6 and FIG. 7, which are respectively shown a stereo view of a modular electrical connector according to the present invention being deposed in an external device, an exploded view of the FIG. 2, a sectional side view of the modular electrical connector, a first stereo view of a RJ45 receiving module according to the present invention, a second stereo view of a RJ45 receiving module, and a stereo view of a connecting module according to the present invention.

As shown in FIGs, a modular electrical connector 1 according to the present invention consists of a housing 10, a plurality of connecting module 20 and a plurality of RJ45 receiving module 30, wherein the housing 10 is used for disposed on a circuit board 50 of an external host case 40, and comprises a metal housing 12 and a plurality of plastic housing 11 being disposed in the metal housing 12 side by side, moreover, a receiving space 101 is provided on the plastic housing 11 for receiving the connecting module 20 and the RJ45 receiving module 30. Furthermore, the housing 10 can also be made of metal material and as an integrated structure, and an accommodating space is provided in the said housing 10 for accommodating the connecting modules 20 and the RJ45 receiving modules 30.

Besides, each the connecting module 20 comprises: a first insulating body 21 and a plurality of connecting terminals 22, wherein the first insulating body 21 is disposed in the receiving space 101 and the plurality of connecting terminals 22 are partially disposed on the first insulating body 21 as well as electrically connected with the circuit board 50. Moreover, each the RJ45 receiving module 30 is disposed into the receiving space 101 and opposite to the connecting module 20, wherein the RJ45 receiving module 30 is used for receiving an external RJ45 plugs, furthermore, moreover, RJ45 receiving module 30 comprises a printed circuit board (PCB) 31 and a plurality of electrical terminals 35 electrically connected to the PCB 31.

In the present invention, the PCB 31 of the RJ45 receiving module 30 is formed with an edge-board contact portion 311, and the edge-board contact portion 311 would connect with contact portions 221 of the connecting terminals 22 when the RJ45 receiving module 30 is disposed in the receiving space 101, such that the electrical terminals 35 are electrically connected with the connecting terminals 22.

Moreover, the first insulating body 21 is formed with a slot 201, and the connecting terminals 22 are partially embedded in the first insulating body 21 by way of insert molding. Furthermore, the connecting portions 221 of the connecting terminals 22 are designed to comprise up-row connecting portions and down-row connecting portions for being disposed on the inner walls of the slot 201; therefore, when the RJ45 receiving module 30 is inserted into the receiving space 101, the PCB 31 is inserted into the slot 201 by the rear thereof, and the up-row and down-row connecting portions 221 contacting with the both sides of the edge-board contact portion 311 of the PCB 31.

In addition, each the RJ45 receiving module 30 further comprises: a shell 38, a second insulating body 32, and two filter members 33,34, wherein the second insulating body 32 is disposed in the shell 38, moreover, two plug slots 301 are vertically formed on the front side of the second insulating body 32 and parallel to each other; furthermore, each of the plug slots 301 are inserted with the electrical terminals 35, and the front side of the PCB 31 being inserted into the rear of the second insulating body 32 for being further welded with the electrical terminals 35.

Besides, one of the two filter members is disposed on top surface of the PCB 31 and the one is disposed on bottom surface of the PCB 31; moreover, each of the filter elements 33,34 are disposed with a plurality of conductive terminals 36 and a plurality of filter coils 37, and the filter coils 37 are electrically connected to the PCB 31 via the conductive terminals 36; furthermore, each of the filter members 33, 34 are formed with a coil accommodating groove 302,303 for accommodating the filter coils 37.

Figure 4:
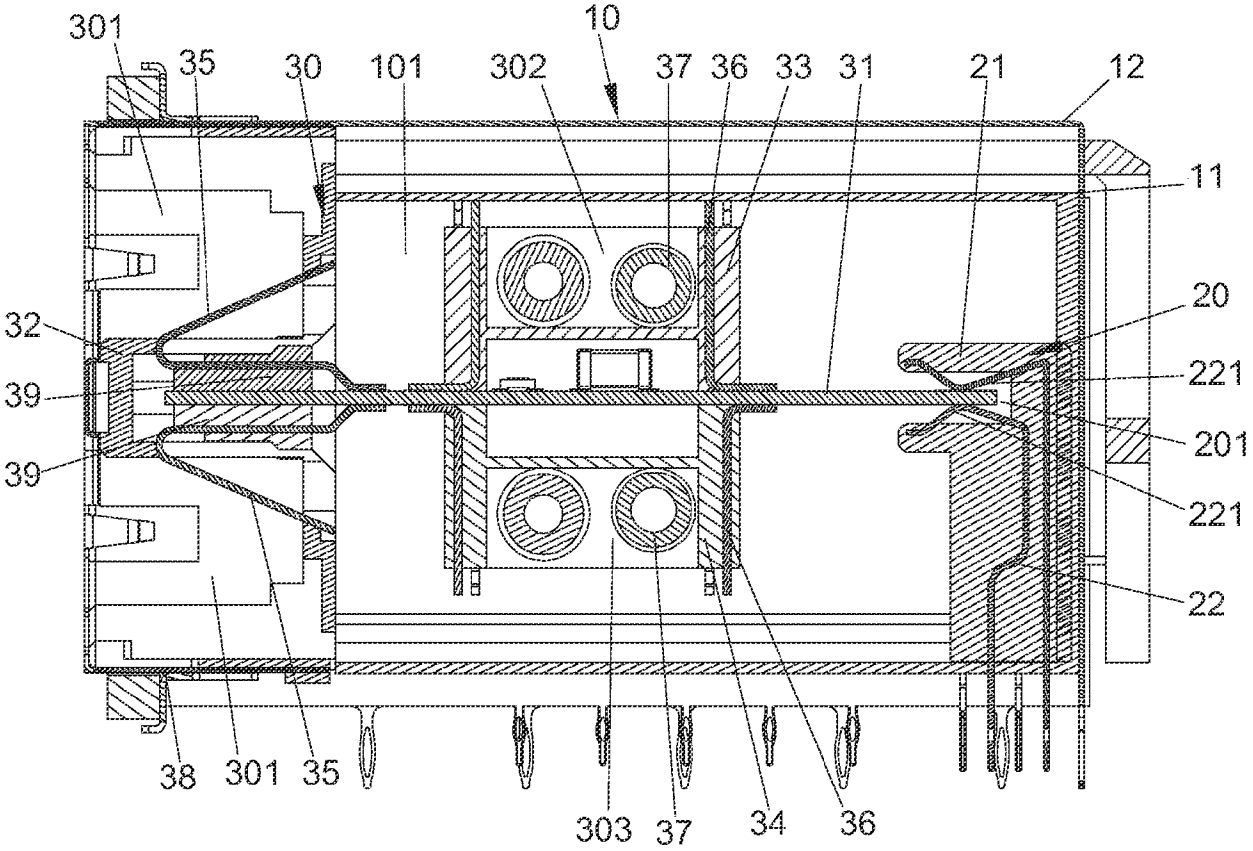
FIG. 4 is a sectional side view of the modular electrical connector.
Figure 5:
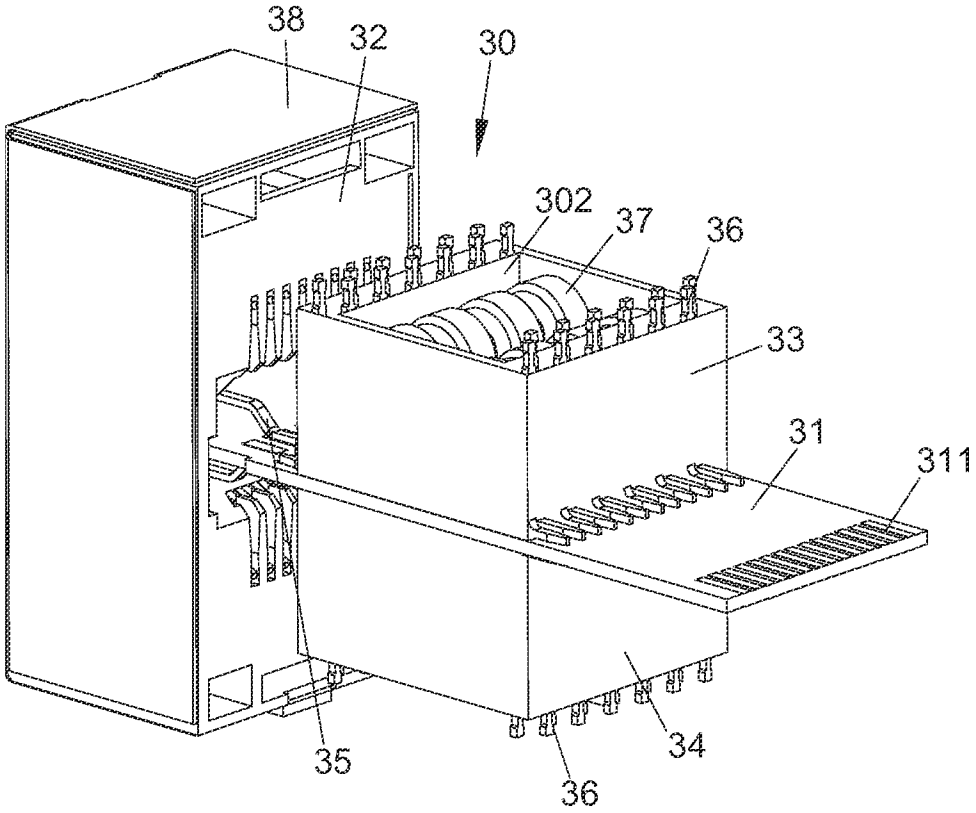
FIG. 5 is a first stereo view of a RJ45 receiving module according to the present invention.
Figure 6:
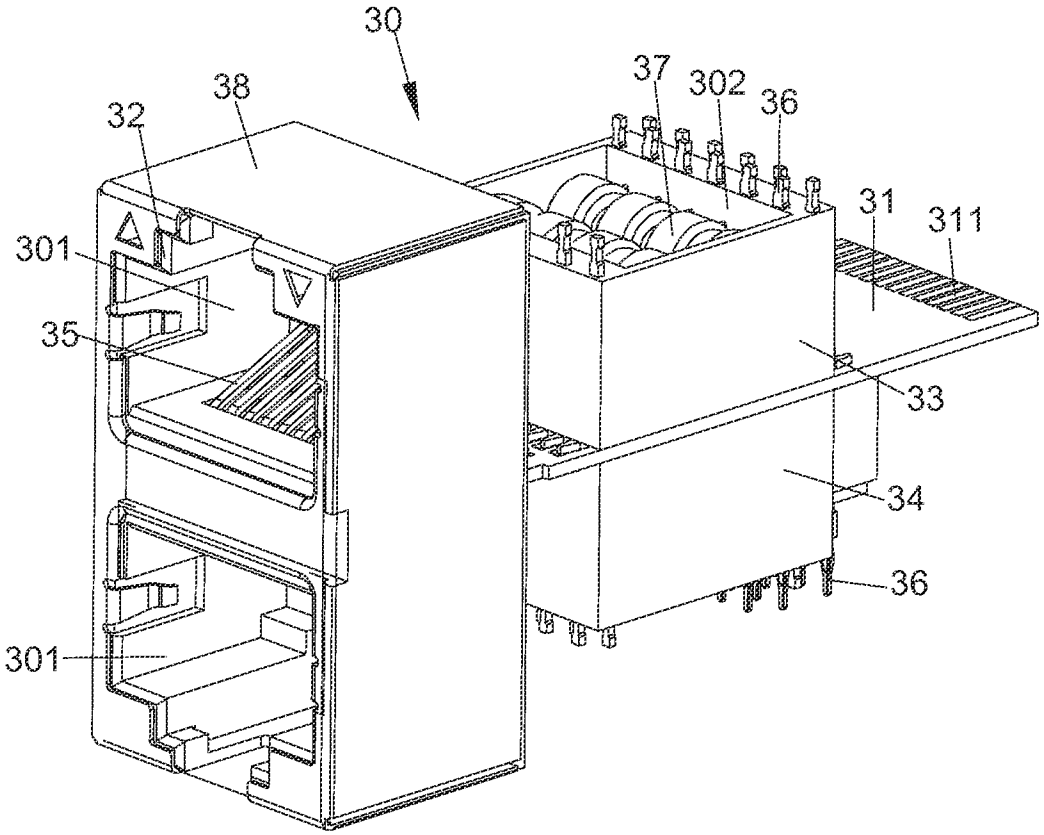
FIG. 6 is a second stereo view of a RJ45 receiving module.
Figure 7:
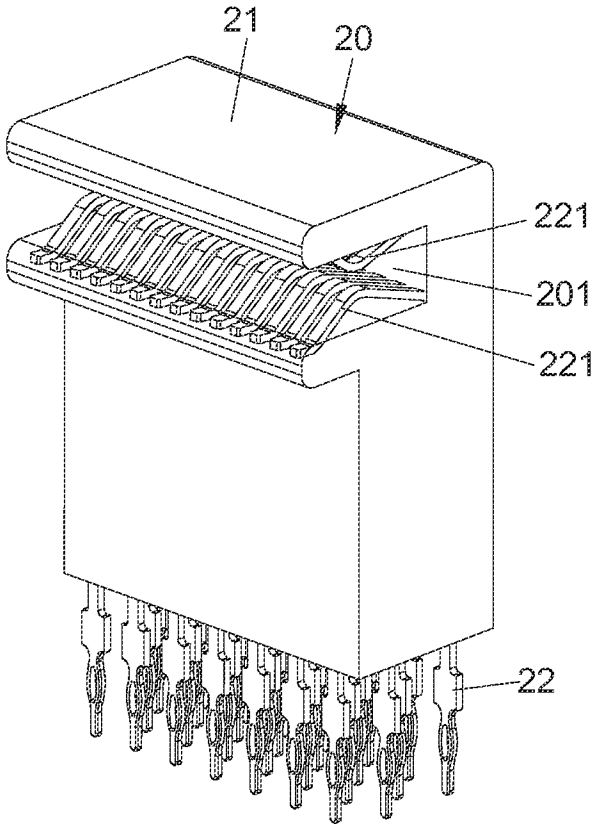
FIG. 7 is a stereo view of a connecting module according to the present invention.

As the FIG. 4, FIG. 5, and FIG. 6 shown, in the embodiment introduced above, the electrical terminals 35 and the conductive terminals 36 are surface mounted terminals and welded on the PCB 31, and the RJ45 receiving module 30 further comprises a third insulating body 39 inserted into the rear of the second insulating body 32, and the electrical terminals 35 are partially embedded in the third insulating body 39 by way of insert molding.

Through above descriptions, the constituting elements of the related technology features of the modular electrical connector of the present invention have been clearly and completely introduced; in addition, the installing process of the modular electrical connector in an external device would be hereby introduced, so as to further explain advantages of the modular electrical connector.

Please refer to FIG. 2 and FIG. 3 again, the processes for installing modular electrical connector 1 in an external device includes following steps: first of all, implementing step (1), respectively assembling the housing 10, connecting modules 20 and RJ45 receiving modules 30; then implementing step (2), disposing the housing 10 and the connecting modules 20 on the circuit board 50 by way of solder-welding or press-fit connection; after finish the step (2), step (3) is carried out for installing the circuit board 50 in the external host case 40.

Inheriting to above description, implementing step (4), inserting the RJ45 receiving modules 30 into the receiving space 101 of housing 10 through the opening 41 of the external host case 40, and making the edge-board contact portion 311 of RJ45 receiving module 30 connect with the contact portions 221 of connecting module 20.

According to the structure and installing processes introduced before, when one of the RJ45 receiving modules 30 needs to be replaced, users can individually pull out and change the receiving module through the opening 41 of the external host case 40, instead of disassemble whole connector and circuit board. Moreover, the major technical feature of the present invention is providing modular structure of the electrical connector, so as to facilitating users to change verity of electrical receiving module according to different kinds of multi-port connector products.

The above description is made on embodiments of the present invention. However, the embodiments are not intended to limit scope of the present invention, and all equivalent implementations or alterations within the spirit of the present invention still fall within the scope of the present invention.

What is claimed is:

1. A modular electrical connector, comprising:

a housing, being disposed on a circuit board of an external host case, and having a receiving space;

at least one connecting module, being disposed in the receiving space, and comprising:

a first insulating body; and a plurality of connecting terminals, being electrically connected with the circuit board, wherein each of the connecting terminals have a contact portion; and at least one RJ45 receiving module, being disposed into the receiving space and opposite to the connecting module, wherein the RJ45 receiving module is used for receiving an external RJ45 plugs; moreover, the RJ45 receiving module comprising a printed circuit board (PCB) and a plurality of electrical terminals electrically connected to the PCB;

wherein the PCB of the RJ45 receiving module is formed with an edge-board contact portion, and the edge-board contact portion would connect with the contact portions of the connecting terminals when the receiving module is disposed in the receiving space, such that the electrical terminals are electrically connected with the connecting terminals and wherein the first insulating body is formed with a slot, and the connecting portions of the connecting terminals are designed to comprise up-row connecting portions and down-row connecting portions for being disposed on the inner walls of the slot therefore, when the RJ45 receiving module is inserted into the receiving space, the PCB is inserted into the slot by the rear thereof, and the up-row and down-row connecting portions contacting with the both sides of the edge-board contact portion of the PCB.

2. The modular electrical connector of claim 1, wherein the housing consists of a metal housing and at least one plastic housing covered by the metal housing; moreover, the said receiving space is provided on the plastic housing for receiving the connecting module and the RJ45 receiving module.

3. The modular electrical connector of claim 2, wherein the number of the plastic housing is plural, and the plurality of the plastic housings being disposed in the metal housing side by side; moreover, the number of the connecting module is plural, and the plurality of the connecting modules being respectively disposed in the plurality of plastic housings; furthermore, the number of the RJ45 receiving module is plural, and the plurality of the RJ45 receiving modules being respectively inserted into the receiving spaces of the plastic housings.

4. The modular electrical connector of claim 1, wherein the housing is made of metal material.

5. The modular electrical connector of claim 1, wherein the connecting terminals are partially embedded in the first insulating body by way of insert molding.

6. The modular electrical connector of claim 1, wherein the RJ45 receiving module further comprises:

a shell;

a second insulating body, being disposed in the shell, wherein two plug slots are vertically formed on the front side of the second insulating body and parallel to each other; moreover, each of the plug slots are inserted with the electrical terminals, and the front side of the PCB being inserted into the rear of the second insulating body for being further welded with the electrical terminals; and two filter members, wherein one of the two filter members is disposed on top surface of the PCB and the one is disposed on bottom surface of the PCB; moreover, each of the filter elements being disposed with a plurality of conductive terminals and a plurality of filter coils, and the filter coils are electrically connected to the PCB via the conductive terminals.

7. The modular electrical connector of claim 6, wherein each of the filter members are formed with a coil accommodating groove for accommodating the filter coils.

8. The modular electrical connector of claim 6, wherein the electrical terminals and the conductive terminals are surface mounted terminals and welded on the PCB.

9. The modular electrical connector of claim 6, wherein the RJ45 receiving module further comprises a third insulating body inserted into the rear of the second insulating body, and the electrical terminals are partially embedded in the third insulating body by way of insert molding.

* * * * *